United States Patent [19]

Heyman et al.

[11] Patent Number: 4,631,752

[45] Date of Patent: Dec. 30, 1986

[54] DISPOSABLE GARMENT SHIELD

[76] Inventors: Eleanor Heyman, 23288 Morningside Dr.; Lois Nager, 22411 Twyckingham, both of Southfield, Mich. 48034

[21] Appl. No.: 724,839

[22] Filed: Apr. 19, 1985

[51] Int. Cl.[4] ..... A41D 27/12

[52] U.S. Cl. ..... 2/56

[58] Field of Search ..... 2/56, 53, 54, 55, 57, 2/58

[56] References Cited

U.S. PATENT DOCUMENTS

| | | | |
|---|---|---|---|
| 108,908 | 11/1870 | Hotchkiss | 2/53 |
| 142,875 | 9/1983 | Sibley | 2/53 |
| 2,434,830 | 1/1948 | Billins et al. | 2/56 |
| 2,556,231 | 6/1951 | Stephens | 2/53 |
| 2,669,720 | 2/1954 | VanDekerck | 2/55 |
| 3,156,924 | 11/1964 | Wonacott | 2/53 |
| 3,345,643 | 10/1967 | Bradley | 2/53 |
| 3,997,920 | 12/1976 | DeWoskin | 2/53 |

*Primary Examiner*—Doris L. Troutman

*Attorney, Agent, or Firm*—Alex Rhodes

[57] ABSTRACT

A low cost single layer disposable shield for preventing soiling of the underarm portions of a garment comprising a thin coated circular sheet having a moisture absorbing side, an opposite moisture repellant side and an adhesive means on the repellant side for attaching the circular sheet to the underarm portion of a garment. The sheet is made from a coarse open fiber moisture absorbent paper material which is coated on one side with a moisture repellant material. Applied onto the adhesive means is a peelable paper which is divided into three contiguous segments along a pair of parallel chordal boundaries of the adjoining segments. An embossed crease extends across the center of the shield and divides the shield into equal parts. When the shield is placed into service the outer segments of the three peelable segments are first removed. Thereafter the shield is folded about the embossed crease and the exposed portions of the adhesive means are pressed against the underarm portion of the garment.

11 Claims, 9 Drawing Figures

FIG. 1
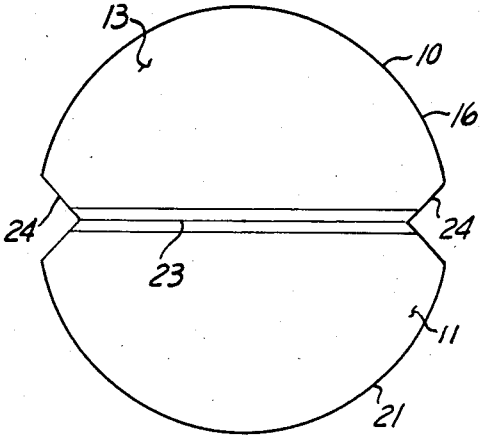
FIG. 2
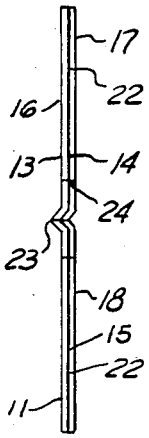
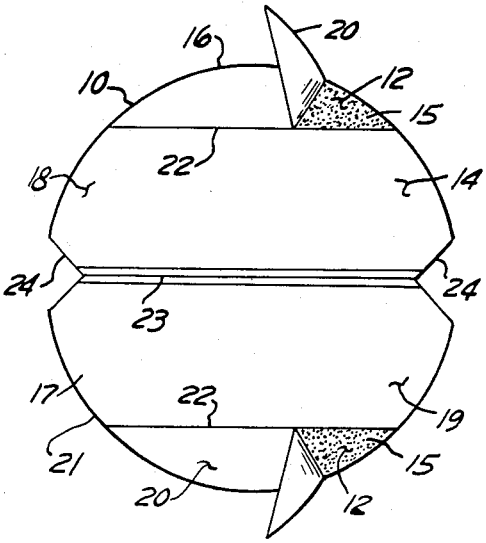
FIG. 3
FIG. 4
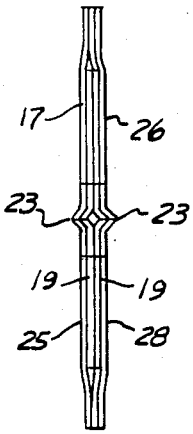
FIG. 5
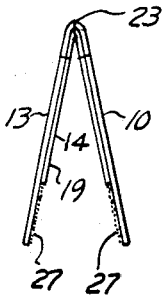
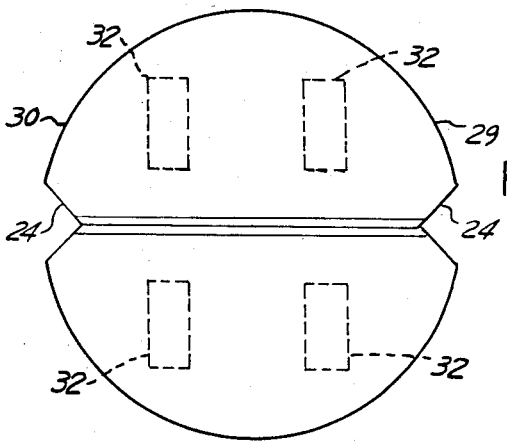
FIG. 6
FIG. 7
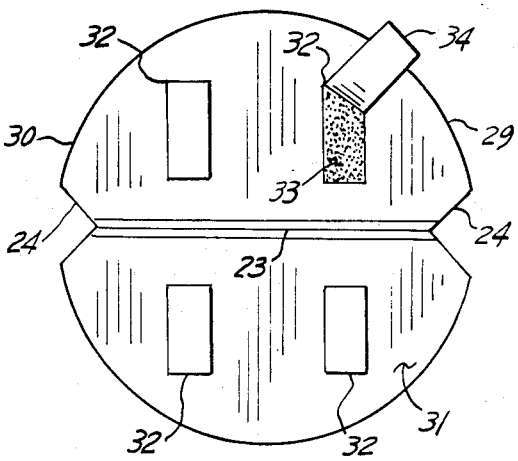
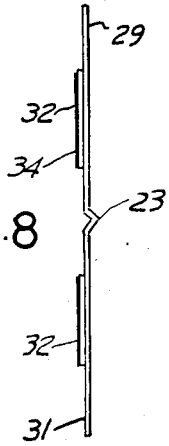
FIG. 8
FIG. 9
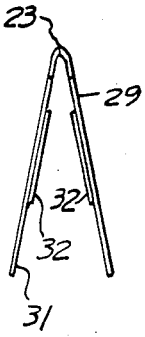

DISPOSABLE GARMENT SHIELD

BACKGROUND OF THE INVENTION

Garment shields are applied to the portions of garments under the armpits of the wearers to prevent garment soiling from the perspiration of the wearers. They consist of two types, namely, re-usable and disposable shields and in either type generally comprise a pair of multi-layer crescent shaped segments joined together at their concave edges. The re-usable shields are periodically removed from the garments, laundered and re-applied whereas disposable shields are discarded after a single use. Marketing tests have shown that the commercial success of this kind of product depends mainly on its price and that low price can significantly increase sales. As yet, dress shields have not attained the level of popularity as other sanitary products. Although disposable shields can be used in all cases, they are particularly useful in retail garment shops where a low cost convenient means is required to prevent loss profits from garment soiling.

As exemplified by the 1870 dress shield patent of Hotchkiss U.S. Pat. No. 108,908, the use of multi-layer materials for dress shields has been a long standing practice in the prior art. The multi-layer crescent shaped segments have consisted of single or multiple layers of moisture absorbent materials joined to single or multiple layers of moisture repellant materials joined to the moisture repellant layers by stitching, bonding or laminating.

With the foregoing in mind, an effective and convenient disposable garment shield made from a single sheet of material would have an important commercial advantage over the characteristic multi-layer shields of the prior art by substantially reducing the cost of the product in the price sensitive market.

SUMMARY OF THE INVENTION

The present invention is related to garment shields and more particularly to a low cost disposable shield for preventing soiling of the portions of garments directly under the armpits of the wearers.

The low cost disposable shield comprises a thin circular coated sheet of a coarse open fiber moisture absorbent paper like material and a means for attaching the coated sheet to the underarm portion of a garment. Extending across the center of the shield is a pre-formed median crease which enables the user to easily fold the shield into two equal halves. The sheet is coated on one side only with a moisture resistent non-hardening adhesive. Applied onto the adhesive coating is a peelable paper which is divided into three contiguous segments bounded by the circular outer margin of the shield and a pair of parallel chordal lines which define the adjoining margins of the segments.

When the shield is placed into service the outer peelable paper segments are first removed to expose the adhesive coating at the end portions of the shield. The shield is then folded about the median crease of the center segment and the exposed portions of adhesive coating at the ends of the shield are pressed against the portion of the garment under an armpit of a wearer.

It is a primary object of the present invention to provide an effective low cost disposable shield for preventing soiling of the underarm portions of garments.

It is another object in addition to the foregoing object to provide a substantial cost reduction in disposable garment shields.

It is another object in addition to the foregoing objects to provide a disposable garment shield which is made from a single piece of coated absorbent sheet material.

Additional objects, features and benefits of the invention will become apparent from the ensuing description and accompanying drawings which disclose the invention in detail. A preferred embodiment is disclosed in accordance with the best mode contemplated in carrying out the invention and the subject matter in which exclusive property rights are claimed is set forth in the numbered claims at the conclusion of the description.

BRIEF DESCRIPTION OF THE DRAWINGS

FIG. 1 is a front view showing a moisture absorbing side of a disposable garment shield.

FIG. 2 is a left side view of the disposable garment shield.

FIG. 3 is a rear view showing the opposite moisture repellant side of the disposable garment shield wherein one segment of peelable paper material is partially removed to expose an underlying adhesive coating.

FIG. 4 is an enlarged side elevational view of a pair of disposable garment shields.

FIG. 5 is an end view of the shield of FIG. 1 showing the shield in a folded configuration prior to its attachment to a garment.

FIG. 6 is a front view showing the moisture repellant side of an alternate embodiment of the garment shield.

FIG. 7 is a front view of the garment shield of FIG. 6 showing the moisture repellent side of the garment shield wherein one layer of peelable paper material is partially removed to expose an underlying adhesive coating.

FIG. 8 is an end view of the alternate embodiment of FIG. 6.

FIG. 9 is an end view of the shield of FIG. 6 showing the shield in a folded configuration prior to its attachment to a garment.

DESCRIPTION OF THE PREFERRED EMBODIMENT

Referring now to the drawings wherein like numerals refer to like and corresponding parts throughout the several views, the particular embodiment of a disposable garment shield 10 disclosed in FIGS. 1 through 5, inclusive, comprises a thin circular coated sheet 11 of an absorbent paper like open fiber material and an adhesive means 12 for attaching the coated sheet 11 to the underarm portion of a garment. One side 13 of the coated sheet 11 is moisture absorbing and the other side 14 is moisture repelling. The absorbent paper like sheet material 11 may be optionally impregnated with a deodorizing or pleasant aromatic substance.

The moisture repellant side 14 is completely coated with a thin layer of a preferably insoluble permanently tacky pressure sensitive adhesive 15, such as, a natural or synthetic rubber based cement. The adhesive coating 15 which is applied to the sheet 16 of absorbent open fiber material by rolling, spraying or other suitable means is also the adhesive means 12 for attaching the shield 10 to a garment.

Overlaying and coextensive with the adhesive coating 15 is a peelable paper 17 which is divided into three contiguous segments 18 consisting of a center segment 19 and a pair of identical outer segments 20. The contiguous segments 18 are bounded by the circular outer margin 21 of the shield 10 and in the orientation shown in the drawings are separated by a pair of parallel horizontal chordal margins 22 which define the upper and lower boundaries of the segments 18. An embossed crease 23 preferably extends across the center of the shield 10 and divides the shield 10 into two equal portions. The crease 23 is parallel to the horizontal chordal margins 22 of the peelable paper segments 18. At each end portion of the shield 10 along the crease 23 is a V-notch 24. The purpose of the V-notch 24 is to remove pointed end portions of the shield 10 when it is folded about the median crease 23.

With reference to FIG. 4, as a packaging feature the outer segments 20 of peelable paper 17 may be omitted from one member 25 of a pair 26 of shields 10 when the shields 10 are supplied in pairs 26. In such case, a pair 26 of shields 10 are held together by adhering the exposed end portions 27 of the non-hardening adhesive coating 15 of one shield 25 to the outer segments 20 of peelable paper 17 of the other shield 28. It will be noted that the opposing center segments 19 of peelable paper 17 serve as spacers and enable the user to easily separate the shields 10.

Referring now to FIG. 5, in the preferred manner of using the invention, the outer segments 20 of peelable paper 17 are first removed to expose the outer portions 27 of the underlying adhesive coating 15 at the opposite end portions of the shield 10 for attaching the shield 10 to a garment. Thereafter, the shield 10 is folded about the median crease 23 to orient the moisture absorbing face 13 outwardly and the moisture repellant face 14 inwardly.

The exposed inward facing portions 27 of adhesive coating 15 are then pressed against the underarm portion of the garment to attach the shield 10 to said garment. Thus, when the shield 10 is in position, the outward facing absorbent face 13 will absorb the perspiration from the armpit of a wearer and the inward facing coated moisture repellant face 14 prevents perspiration from contacting the garment.

It will be observed that the retention of the center segment 19 of peelable paper 17 on the shield 10 provides several benefits, namely: (1) the moisture resistance of the inwardly facing surface 14 is increased, (2) the shield 10 is more easily applied to the garment because the center portions of the inward facing surfaces 14 are prevented from adhering to each other, and (3) of shield 10 is more easily removed from the garment.

With reference to FIGS. 6 through 9, inclusive, an alternate embodiment 29 of the present invention is disclosed therein comprising a coated sheet 30 of absorbent open fiber paper like material having a thin coating 31 of a non-adhesive pliable moisture resistent plastic material in lieu of the adhesive coating 15 of the first embodiment 10. The thin plastic coating 31 is applied to one side only of the absorbent paper like material 30 by spraying or other suitable means. Attached to the moisture repellant plastic coating 31, on opposite sides of the median crease 23, is a pair of conventional tape strips 32. Each of the tape strips 32 is double sided coated with a permanently tacky non-hardening pressure sensitive adhesive 33. Applied onto the adhesive coating 33 on the outer side of each tape strip 32 is a peelable segment 34 of a paper like material.

From the foregoing detailed description it will be appreciated that our invention provides an effective garment shield which is easily applied by the user and has the important advantage of a significant cost reduction over the prior art. It will be further appreciated that our invention can be made in large quantities on high speed automatic machinery to reduce manufacturing costs.

Although but two embodiments have been disclosed and described in detail it will be still further appreciated that changes can be made in the shape, details and materials of the invention without departing from the spirit thereof.

We claim:

1. Disposable shield for preventing soiling of the portions of a garment directly below the armpits of a user comprising in combination:

(a) a single thin circular coated flat sheet of a highly absorbent fibrous paper material for absorbing the perspiration from the armpits of the user and the other side of said absorbent material having a coating means on one side of said sheet for preventing perspiration of the user from contacting said garment;

(b) adhesive means for attaching the shield to the garment of the user, said adhesive means being on the same side of said sheet as said coating means which prevents perspiration from contacting the garment of the user; and (c) an embossed crease extending across the center of said flat sheet of material.

2. Disposable shield recited in claim 1 wherein said moisture absorbing material is impregnated with a deodorizing substance.

3. Disposable shield recited in claim 1 wherein said moisture absorbing material is impregnated with a pleasant aromatic substance.

4. Disposable shield recited in claim 1 further comprising a thin peelable material bonded onto said adhesive means.

5. Disposable shield recited in claim 1 wherein said coating means for preventing perspiration from contacting said garment and said adhesive means for attaching the shield are the same and comprise a coating of water insoluble non-hardening pressure sensitive adhesive substantially covering one side of said sheet.

6. Disposable shield recited in claim 2 wherein said water repellant coating is a thin plastic coating.

7. Disposable shield recited in claim 1 wherein the coated sheet of absorbent material has a V-notch at each end portion of said crease.

8. Disposable shield for preventing soiling of the portions of a garment directly below the armpits of a user comprising in combination:

(a) a thin circular coated sheet of a highly absorbent fibrous paper material, one side of said absorbent sheet of material being uncoated for absorbing perspiration from the armpits of a user and the entire other side of said absorbent material being substantially coated with a water insoluble non-hardening pressure sensitive adhesive for preventing said perspiration from contacting said garment and providing a means for attaching the shield to a garment; and (b) a thin layer of peelable material applied onto the entire surface of said adhesive coating and comprised of a center segment and two contiguous identical outer end segments, said peelable segments being bounded by the circular outer margin of the shield and divided by a pair of chordal margins whereby the shield may be attached to a garment by removing the end segments to expose the end portions of the adhesive coating.

9. Disposable shield for preventing soiling of the portions of a garment directly below the armpits of a user comprising in combination:

(a) a thin circular coated sheet of a highly absorbent fibrous paper material, one side of said absorbent sheet of material being uncoated for absorbing perspiration from the armpits of a user and the other side of said absorbent material having a thin plastic moisture repellant coating for preventing said perspiration from contacting said garment, and an embossed crease extending across the center of said circular sheet;

(b) adhesive means applied onto opposite end portions of said moisture repellant side for attaching the shield to the garment of a user; and (c) a thin layer of peelable material applied onto each of said adhesive coated portions.

10. Disposable shield recited in claim 9 wherein said adhesive means comprises a first pair of double sided adhesive coated tape strips on one side of said crease and a second pair of double sided adhesive coated tape strips on the other side of said crease.

11. Disposable shield recited in claim 5 further comprising:

(a) a second circular flat sheet oriented with the adhesive coated side aligned with and facing the adhesive coated side of the other circular flat sheet, said sheets being joined together by the end portions of said adhesive coated sides; and (b) a thin sheet of peelable material between the center portions of said circular sheets, one side of said sheet of peelable material being adhesively bonded to one of said circular sheets and the other side of sheet of peelable material being adhesively bonded to the other of said circular sheets.

* * * * *